US005108517A

United States Patent [19]

Kimura et al.

[11] Patent Number: 5,108,517

[45] Date of Patent: Apr. 28, 1992

[54] PROCESS FOR PREPARING TITANIUM AND TITANIUM ALLOY MATERIALS HAVING A FINE EQUIAXED MICROSTRUCTURE

[75] Inventors: Kinichi Kimura; Masayuki Hayashi; Mitsuo Ishii; Hirofumi Yoshimura, all of Hikari; Jin-ichi Takamura, Kawasaki, all of Japan

[73] Assignee: Nippon Steel Corporation, Tokyo, Japan

[21] Appl. No.: 558,643

[22] Filed: Jul. 26, 1990

[30] Foreign Application Priority Data

| | | | |
|---|---|---|---|
| Jul. 31, 1989 | [JP] | Japan | 1-198637 |
| Oct. 16, 1989 | [JP] | Japan | 1-266310 |
| Dec. 25, 1989 | [JP] | Japan | 1-336095 |
| Mar. 6, 1990 | [JP] | Japan | 2-54592 |

[51] Int. Cl.[5] ..... C22C 14/00; C22C 1/00

[52] U.S. Cl. ..... 148/11.5 R; 148/11.5 F; 148/12.7 B; 148/133

[58] Field of Search ..... 148/11.5 F, 12.7 B, 148/133, 11.5 R

[56] References Cited

U.S. PATENT DOCUMENTS

| | | | |
|---|---|---|---|
| 2,892,742 | 6/1959 | Zwicker et al. | 148/11.5 |
| 4,415,375 | 11/1983 | Lederich et al. | 148/11.5 F |
| 4,820,360 | 4/1989 | Eylon et al. | 148/133 |
| 4,822,432 | 4/1989 | Eylon et al. | 148/127 |
| 4,832,760 | 5/1989 | Eylon et al. | 148/20.3 |
| 4,871,400 | 10/1989 | Shindo et al. | 148/11.5 F |
| 4,889,170 | 12/1989 | Mae et al. | 148/12.7 B |
| 4,923,513 | 5/1990 | Ducheyne et al. | 75/245 |

FOREIGN PATENT DOCUMENTS

| | | | |
|---|---|---|---|
| 63-4908A | 3/1986 | Japan . | |
| 63-4914A | 11/1986 | Japan . | |
| 1096359 | 4/1989 | Japan | 148/11.5 F |
| 2025553 | 1/1990 | Japan | 148/11.5 F |

OTHER PUBLICATIONS

W. R. Kerr et al. "Hydrogen as an alloying element in titanium (Hydrovac)" *Titanium* '80 pp. 2477 2486.

N. C. Birla et al., "Anisatropy Control through the use of hydrogen in Ti-6Al-4V alloy" *Transaction of the india Institute of Metals*, vol. 37, No. 5, Oct. 1984, pp. 631-635.

W. R. Kerr, "The Effect of Hydrogen as a Temporary Alloying Element on the Microstructure and Tensile Properties of Ti-6Al-4V" *Metallurgical Transactions* A, vol. 16A, Jun. 1985 pp. 1077~1087.

Proceedings of Titanium '80 Conference, May 22, 1980, pp. 2477-2481, W. Kerr et al.

*Primary Examiner*—Upendra Roy

*Attorney, Agent, or Firm*—Kenyon & Kenyon

[57] ABSTRACT

According to the present invention, titanium and titanium alloy materials having a fine equiaxed microstructure are produced. A titanium, $\alpha$ titanium alloy or $(\alpha+\beta)$ titanium alloy material is hydrogenated in an amount of 0.02 to 2% by weight. If necessary, the hydrogenated material is subjected to pretreatment [i.e., heated above 700° C. ($\beta$ transformation point)] and/or working (i.e., working at 450° to 950° C., or temperatures above $\beta$ transformation point and below 1100° C.). The material is then aged at 10° to 530° C. or 10° to 700° C. (in the case of working at temperatures above $\beta$ transformation point), and finally dehydrogenated and recrystallized to prepared a material having a fine equiaxed microstructure.

16 Claims, 4 Drawing Sheets

20μm

PROCESS FOR PREPARING TITANIUM AND TITANIUM ALLOY MATERIALS HAVING A FINE EQUIAXED MICROSTRUCTURE

BACKGROUND OF THE INVENTION (1) Field of the Invention

The present invention relates to a process for preparing titanium and a titanium alloy material having a superior fatigue strength and workability particularly a process for preparing a titanium, $\alpha$ titanium alloy or $(\alpha+\beta)$ titanium alloy having a fine equiaxed microstructure.

(2) Description of the Related Art

Titanium and its alloys have been used in various material applications, including aerospace materials, owing to their high strength-to-density ratio and high corrosion resistance, and the applications thereof are expanding. The reason why titanium and $\alpha$ and $(\alpha+\beta)$ titanium alloys are in such great demand is that they have a high strength and ductility, but the characteristics requirements in each field are very strict, and in particular, aerospace materials, etc., used under an environment subject to cyclic stresses must have superior fatigue properties, in addition to a good workability. This has led to establishment of strict quality standards (e.g., as seen in AMS4967), and to meet such requirements, the $\alpha$ grain of the material must have a fine equiaxed microstructure.

Since the impurity contents of titanium are limited, an equiaxed microstructure can be obtained by the conventional working and heat treatment, but it has been difficult to homogeneously refine the microstructure.

On the other hand, products used in the above-described field and having various shapes (plate, wire, tube, rod, etc.) and made of $\alpha$ and $(\alpha+\beta)$ titanium alloys, are usually manufactured by a combination of hot working and heat treatments. The step of the hot working, however, has a drawback that a proper working temperature range is too narrow to satisfy both of the following requirements; (1) ensuring of a good workability for attaining a very precise product shape, (2) a formation of an equiaxed microstructure in the product.

Further, in the above-described temperature range, the microstructure is highly sensitive to temperature change; for example, even a slight rise in the temperature causes grain growth, and thus the microstructure after working tends to become heterogeneous. Further, the microstructure formed during hot working does not undergo any significant change.

This has led to proposals for a process for preparing $\alpha$ and $(\alpha+\beta)$ titanium alloys having an equiaxed microstructure, e.g., a preparation process disclosed in Japanese Examined Patent Publication No. 63-4914 wherein heating and working are repeated in a specific narrow temperature range, and a preparation process disclosed in Japanese Examined Patent Publication No. 63-4908, wherein a hot rolling material is heated at temperatures above the $\beta$ transformation point. Nevertheless, these processes cannot satisfactorily attain a homogeneously fine equiaxed microstructure of a material. Further, the former is disadvantageous in that the productivity is poor and the production cost is high.

Techniques which utilize hydrogen as a temporary alloying element in titanium alloys for improving their workability and microstructure are disclosed in the following literature.

(1) U. Zwicker et al., U.S. Pat. No. 2,892,742 (issued on Jun. 30, 1959):

This patent describes that an $\alpha$ titanium alloy having an Al content of 6% or more is hydrogenated in an amount of 0.05 to 1.0% by weight of hydrogen, to improve the hot workability, and finally, dehydrogenated in vacuum, but makes no mention of a refinement of the microstructure.

(2) W.R. Kerr et al., "Hydrogen as an alloying element in titanium (Hydrovac)", Titanium ,80, P. 2477-2486:

This paper states that a hydrogenation of Ti-6Al-4V alloy as an $(\alpha+\beta)$ titanium alloy improves the hot workability through a lowering of the $\beta$ transformation point, and provides a fine microstructure. The hot working is conducted by forging at a reduction of 60% or less, and the forging is conducted in a slow speed ram motion system at a ram speed of $1.27 \times 10^{-3}$ or less. Namely, this working is not a practical working such that a strong working can be conducted by hot rolling, etc.

(3) N. C. Birla et al., "Anisotropy control through the use of hydrogen in Ti-6Al-4V alloy", Transactions of the Indian Institute of Metals, Vol. 37, No. 5, Oct. 1984, P. 631-635:

This paper states that a hydrogenation of Ti-6Al-4V alloy as an $(\alpha+\beta)$ titanium alloy followed by hot rolling improves the anisotropy of tensile properties. In this process, however, a hydrogenated plate is homogenized at 990° C. for 2 hrs, and a 50% rolling at 730° C. is conducted in several passes of a 10% reduction of each pass with a homogenization treatment of 10 minutes after each reduction, which renders this process unsuitable for practical use.

(4) D. Eylon et al., U.S. Pat. No. 4,820,360 (Apr. 11, 1989):

This patent discloses a method of refining the microstructure of cast titanium alloy articles, which method comprises heating a cast article at 780° to 1020° C. in a hydrogen-containing atmosphere to hydrogenate the cast article, cooling the hydrogenated cast article to room temperature at a controlled rate of 5° to 40° C./min, and heating the cooled hydrogenated cast article in vacuum at 650° to 750° C. for dehydrogenation.

(5) D. Eylon et al., U.S. Pat. No. 4,832,760 (May 23, 1989):

This patent discloses a method of refining the microstructure of prealloyed titanium alloy powder compacts, which method comprises heating a compacted article in a hydrogen-containing atmosphere at 780° to 1020° C. for hydrogenation, cooling the hydrogenated compacted article to room temperature at a rate of 5° to 40° C., and heating the cooled hydrogenated compacted article in vacuum at 650° to 750° C. for dehydrogenation.

(6) W. R. Kerr, "The Effect of Hydrogen as a Temporary Alloying Element on the Microstructure and Tensile Properties of Ti-6Al-4V", METALLURGICAL TRANSACTIONS A, Vol. 16A, June 1985, P. 1077-1087:

The method disclosed in this paper comprises hydrogenating Ti-6Al-4V alloy as an $(\alpha+\beta)$ titanium alloy, heating the hydrogenated alloy at 870° C., subjecting the heated alloy to eutectoid transformation at 540° to 700° C., and dehydrogenating the transformed alloy at 650° to 760° C. to obtain a fine equiaxed microstructure.

Nevertheless, the above-described prior arts do not provide a sufficiently fine equiaxed microstructure, i.e., are unsatisfactory when attempting to stably prepare titanium and titanium alloys having a high strength, fatigue properties, and workability, etc., on a commercial scale.

SUMMARY OF THE INVENTION

An object of the present invention is to form a fine and equiaxial microstructure of titanium, $\alpha$ titanium alloys and $(\alpha+\beta)$ titanium alloys to an extent unattainable in the prior arts, and to provide a process for stably preparing the above-described materials having a high strength, fatigue properties, and workability, etc., on a commercial scale.

To attain the above-described object, the present invention has the following constitution.

Specifically, the present invention relates to a process for preparing titanium and $\alpha$ and $(\alpha+\beta)$ titanium alloys, characterized by comprising aging, at temperatures of 10° to 530° C., a material hydrogenated in an amount of 0.02 to 2.0% by weight of hydrogen, and then dehydrogenating in vacuum, and simultaneously, recrystallizing the material. In this case, prior to the aging, the hydrogenated material may be subjected to a pretreatment such that it is heated at 700° C. or higher and then cooled. Further, the present invention provides a process which comprises, working the above-described hydrogenated material in the $(\alpha+\beta)$ region at 450° to 950° C. with a reduction of 30% or more, aging the material, and dehydrogenating and recrystallizing the aged material. Further, the present invention includes a process which comprises, subjecting the above-described hydrogenated material to a heat treatment, i.e., heating the material at temperatures above the $\beta$ transformation point, and cooling the heated material, and then conducting the above-described working, aging, and annealing in vacuum. The working temperatures for titanium, $\alpha$ titanium alloys and $(\alpha+\beta)$ titanium alloys are preferably 450° to 800° C., 600° to 950° C., and 550° to 900° C., respectively. Further, the present invention provides a process which comprises working the hydrogenated material at temperatures above the $\beta$ transformation point and below 1100° C., with a reduction of 30% or more, finishing the working in a $\beta$ single phase region, aging the worked material at temperatures of 10° to 700° C., and then annealing the aged material in vacuum. In this case, the above-described process may include a step of a heat treatment, which comprises heating the above-described hydrogenated material at temperatures above the $\beta$ transformation point and below 1100° C. and then cooling the heated material to 400° C. or lower.

DESCRIPTION OF THE PREFERRED EMBODIMENTS

Figure 1:
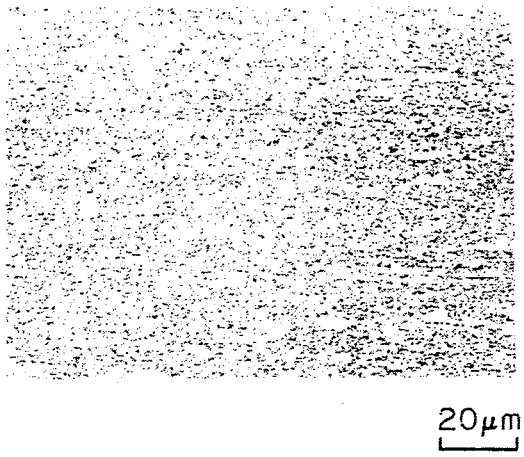
FIGS. 1 to 7 are microphotographs (×500), wherein FIGS. 1 to 5 correspond to examples of the present invention and FIGS. 6 and 7 correspond to comparative examples.

The present invention enables the microstructure of titanium and $\alpha$ and $(\alpha+\beta)$ titanium alloys to be rendered fine and equiaxed without the conventional working and heat treatment, and provides a material having superior fatigue properties and workability.

To solve the above-described problems of the prior arts, the present inventors considered hydrogen, which can be easily incorporated in titanium and removed therefrom, and conducted various studies to that end, and as a result, found the following facts.

(a) When titanium and $\alpha$ and $(\alpha+\beta)$ titanium alloys are hydrogenated and then aged at relatively low temperatures, titanium hydrides finely precipitate in the material and high density dislocations are introduced in the interior of hydrides and their surrounding regions as well. For the precipitation, the better results can be obtained when the hydrogen content is higher and the aging is conducted under lower temperatures and longer times. This causes the hydride to dispersively precipitate in a larger amount as well as in a finer state, so that the dislocation density described above becomes high. When this material is heated in vacuum, it is dehydrogenated and simultaneously a number of recrystallization nuclei are formed from the dense dislocation field, thus resulting in the formation of a fine equiaxed microstructure.

(b) When the material is heated at proper temperatures in the $(\alpha+\beta)$ two phase region or the $\beta$ single phase region and then cooled, hydrogen is more homogeneously dissolved during heating, which results in a formation of a fine acicular martensitic microstructure from the stabilized and increased $\beta$ phase during cooling. This causes the hydride to more homogeneously and finely precipitate and, at the same time, high density dislocations to be introduced in the interior of hydrides and their surrounding regions in subsequent aging, so that a more homogeneous and finer recrystallization microstructure can be obtained after final annealing in vacuum.

(c) When titanium and $\alpha$ and $(\alpha+\beta)$ titanium alloys are hydrogenated, hydrogen is dissolved, so that the proportion of the $\beta$ phase having an excellent workability becomes high even in a relatively low temperature region.

Therefore, if necessary, after a $\beta$ heat treatment is conducted, wherein the material is heated above the $\beta$ transformation point and then cooled, the hot working can be conducted in an $(\alpha+\beta)$ region at temperatures below those used in the prior arts. This prevents the grain growth during working at relatively high temperatures in the prior arts, and further, during such working, a strain is accumulated and a hydride precipitated, so that high density dislocations are introduced into the material. During the subsequent aging, the hydride further precipitates to enhance the dislocation density. This enables more fine and equiaxed microstructure to be obtained during recrystallization in the subsequent annealing in vacuum.

(d) When titanium and $\alpha$ and $(\alpha+\beta)$ titanium alloys are hydrogenated, hydrogen is dissolved in the material to lower the $\beta$ transformation point. This enables the working in a $\beta$ region having an excellent workability to be conducted at temperatures below those used in the prior arts. As a result, coarsening of $\beta$ grains can be prevented during hot working in the $\beta$ region, and a fine acicular martensitic microstructure is formed during cooling after the completion of the working in the $\beta$ region. This causes a fine hydride to precipitate during the subsequent aging, so that grains in the microstructure are refined.

The present invention will now be described in more detail.

The present inventors have conducted various experiments on the hydrogen content, heating temperature, working temperature, reduction, and aging temperature necessary for a refinement of grains in the microstructure, and thus completed the present invention.

Examples of the object material of the present invention include commercially available pure titanium such as titanium specified in JIS (Japanese Industrial Standards), $\alpha$ titanium alloys such as Ti-5Al-2.5Sn, and $(\alpha+\beta)$ titanium alloys such as Ti-6Al-4V. Casting materials such as ingot, hot working materials subjected to blooming, hot rolling, hot extrusion, etc., or cold working materials, and further powder compacts, etc., may be used as the material. The reason for the limitation of the hydrogen content is as follows. When the hydrogen content is less than 0.02% by weight, the amount of the hydride precipitated during aging is too small to form the intended fine equiaxed microstructure in the subsequent annealing. On the other hand, when the hydrogen content exceeds 2% by weight, the hydride precipitates in a large amount during aging. In this stage, however, the material per se becomes very brittle, which brings about problems in the handling of the material such as that it becomes impossible to conduct subsequent annealing in vacuum. Therefore, the hydrogen content is limited to 0.02 to 2% by weight. The hydrogenation method depends upon the hydrogenation during melting, heat treatment in a hydrogen atmosphere, etc., but there is no particular limitation on the hydrogenation methods and conditions.

The aging of the above-described material will now be described.

When the aging temperature is below 10° C., the hydride is finely precipitated, but a very long time is needed for the precipitation, which renders these temperatures impractical from the view point of industry. On the other hand, when the aging temperature exceeds 530° C., although precipitated in a large amount, the hydride is coarsened. Further, when the temperature is too high, the hydride unfavorably redissolves, which makes it impossible to form the intended fine equiaxed microstructure in subsequent annealing. Therefore, the aging temperature is limited to 10° to 530° C. Although there is no particular limitation on the holding time, it should be 1 min to 50 hr (holding for a short time in the case of a high temperature and holding for a long time in the case of a low temperature). Specific examples of the method of aging include one wherein the material is heated from room temperature to the aging temperature and held at that temperature, one wherein the material is held at a room temperature of 10° C. or higher, and one wherein the material is cooled from the hydrogenating temperature, pretreatment temperature or working temperature to the aging temperature and then held at that temperature.

After the above-described aging, annealing is conducted in vacuum, as a final step, to dehydrogenate and simultaneously recrystallize the material. There is no particular limitation on the annealing conditions, and the annealing may be conducted under conditions commonly used for recrystallization after working, but preferably, the annealing temperature is as low as possible. Specifically, the annealing temperature and time are preferably 500° to 900° C. and 100 hr or less, respectively. A remaining of hydrogen in a certain amount or more becomes a cause of embrittlement and deteriorates the product characteristics. The degree of vacuum may be a reduced pressure of about $1\times10^{-1}$ Torr or less. The higher the degree of vacuum, the shorter the annealing time. It is preferred from the practical point of view that the reduced pressure be about $1\times10^{-4}$ Torr and the residual gas be an inert gas such as argon.

Pretreatments optionally conducted prior to the above-described aging will now be described.

As described above, pretreatments prior to the aging make the microstructure formed by the final vacuum annealing more homogeneous and fiber. When the temperature for the pretreatment is below 700° C., the amount of the $\beta$ phase is small and the effect of a formation of the above-described martensitic microstructure on refining the microstructure becomes poor. Therefore, the temperature for the pretreatment is limited to 700° C. or higher. When the temperature is 700° C. or higher, the amount of the $\beta$ phase increases and the $\beta$ single phase region is formed depending upon the hydrogen content, so that a finer microstructure as described above is obtained. There is no particular limitation on the upper limit of the pretreatment temperature, but preferably the upper limit is about 1100° C., from the viewpoint of surface oxidation and operations such as the performance of heat treating furnace. Although there is no particular limitation on the holding time, at least 1 min is necessary. With respect to cooling after holding, any of furnace cooling, air cooling, and water quenching may be applied, but a higher cooling rate is preferred. The finishing temperature of cooling is preferably 530° C. or lower.

The above-described process of the present invention may be applied to materials having an acicular microstructure such as the above-described commercially available pure titanium, $\alpha$ titanium alloys and $(\alpha+\beta)$ titanium alloys or the above-described welded materials, brazed materials and welded pipe products.

Specifically, the above-described materials and products having a coarse acicular microstructure are hydrogenated in an amount of 0.02 to 2% by weight of hydrogen. If necessary, the hydrogenated materials are subjected to a pretreatment such that they are heated at a temperature of 700° C. or higher and then cooled. The pretreated materials are aged at temperatures of 10 to 530° C. and then vacuum-annealed to dehydrogenate and, at the same time, to recrystallize the materials, thereby forming a fine equiaxed microstructure to improve the fatigue properties and workability, etc.

Hydrogenation can be conducted by heat-treating the material in a hydrogen atmosphere. For a welding construction material, the material may be welded in an atmosphere comprising a mixture of an inert gas such as argon with hydrogen, or the material may be hydrogenated prior to welding and then welded.

Wording in the $(\alpha+\beta)$ region optionally conducted prior to the aging will now be described.

In the present invention, the working is conducted by rolling, extrusion, and forging, etc. As described above, hydrogenation of a material facilitates working in the $(\alpha+\beta)$ region at low temperatures. The higher the hydrogen content, the greater the above-described tendency. But there is the temperature range appropriate for working in the $(\alpha+\beta)$ region on the low temperature side. Specifically, when the temperature is below 450° C., cracking occurs during working. On the other hand, when the temperature is above 950° C., a $\beta$ region is formed depending upon the material or the hydrogen content. Therefore, the working temperature is limited to 450° to 950° C.

The object materials, i.e., titanium, $(\alpha+\beta)$ titanium alloys and $\alpha$ titanium alloys, are slightly different from each other in the workability, and the workability is slightly poorer in the order of titanium, ($\alpha+\beta$) alloys and $\alpha$ titanium alloys, and the $\beta$ transformation point becomes high in that order. Therefore, it is preferred that titanium, ($\alpha+\beta$) titanium alloys and $\alpha$ titanium alloys be worked in each ($\alpha+\beta$) region at 450° to 800° C. being low temperatures, 550° to 900° C. and 600° to 950° C. being high temperatures, respectively.

The reduction in the above-described working temperature region varies, depending upon whether or not the $\beta$ heat treatment is conducted prior to working. In the process wherein no $\beta$ heat treatment is conducted [in the case of claim (3)], working with a reduction of 30% or more enables fine equiaxed recrystallized grains to be formed by recrystallization annealing after aging.

In the process wherein the $\beta$ heat treatment is previously conducted [in the case of claim (4)], the above-described limitation of the reduction is unnecessary. Specifically, when a hydrogenated material is heated at temperatures above the $\beta$ transformation point and then cooled, the material per se also becomes a fine microstructure. Therefore, even when the reduction in the working of such a material is less than 30%, it is possible to prepare fine recrystallized grains through subsequent aging and annealing in vacuum. The effect is significant when the reduction is 15% or more.

The term "reduction" used therein is intended to mean a total reduction of one or more workings.

In the $\beta$ transformation, the material is heated above the $\beta$ transformation point and then cooled for the purpose of forming a fine microstructure. In this case, the heating temperature is preferably as low as possible. The holding time is preferably 1 to 60 min. The cooling may be conducted by any of furnace cooling, air cooling and water quenching, but the higher the cooling rate, the better the results. When the finishing temperature of cooling is about 300° C. below the $\beta$ transformation point, a fine microstructure can be obtained. After the material is heated above the $\beta$ transformation point, it is worked by a method wherein the material is worked in the above-described working temperature range in the course of cooling, a method which comprises re-heating the material in the course of cooling or re-heating the material cooled to room temperature and then working the re-heated material in the above-described working temperature range, or a method which comprises holding the material in the course of cooling at a certain temperature in a heat temperature range and conducting the working at that temperature.

There is no particular limitation on the upper limit of the above-described reduction, and the reduction may be in a usually workable range. Further, there is no particular limitation on the working time. After the working, the aging is conducted after cooling to room temperature or in the course of cooling. In this case, there is no particular limitation on the cooling rate, but the higher the cooling rate, the better the results. After the aging, as described above, the aged material is annealed in vacuum.

Working in the $\beta$ region, optionally conducted prior to the above-described aging, will now be described.

In this case, the $\beta$ transformation point is lowered by hydrogenation to conduct working at a temperature in the $\beta$ single phase region having an excellent workability.

Specifically, the working is conducted at temperatures above the $\beta$ transformation point and finished in the $\beta$ region. When the temperature raised above the $\beta$ transformation point is too high, the $\beta$ grains are coarsened, which makes it difficult to obtain a fine equiaxed microstructure as a final intended product. For this reason, the heating temperature is limited to less than 1100° C. As described above, the working is finished in the $\beta$ region for forming a fine and acicular martensitic microstructure during cooling.

In the process described in claim 8, the hydrogenated material is heated at temperatures above the $\beta$ transformation point, as described above to conduct working. In this case, in consideration of including of coarse grains in the microstructure of the material, the reduction is limited to 30% or more to refine the coarse grains.

In the process described in claim 9, the hydrogenated material is pretreated, i.e., heated above the $\beta$ transformation point and cooled to 400° C. or below, and again heated above the $\beta$ transformation point to conduct working. In this case, the $\beta$ heat treatment as the pretreatment is conducted in consideration of including of coarse grains in the microstructure of the material. Since the microstructure is refined by this treatment, the reduction in the above-described working may be 30% or less, but the effect is significant when the reduction is 15% or more.

The term "reduction" used herein is intended to mean a total reduction in one or more workings.

In the present invention, the cooling in the $\beta$ heat treatment as the pretreatment may be conducted by any of furnace cooling, air cooling and water quenching, but the higher the cooling rate, the better the result, for the fine microstructure.

After the above-described working, the material is applied to the above-described aging and annealing in vacuum. In this case, as opposed to the working in the ($\alpha+\beta$) region, the upper limit of the aging temperature can be increased to 700° C., which makes it possible to shorten the aging time, but a more significant effect on microstructure refining can be attained when the aging temperature is 530° C. or lower.

In the above-described present invention, if a slight heterogeneous portion occurs in the microstructure of the material after annealing in vacuum due to the remaining of a coarse $\alpha$ phase around the former $\beta$ grain boundary, one or two additional cold working-annealing procedures can be conducted to homogenize the microstructure.

Further, in the present invention, a series of treatments of the present invention can be repeated twice or more. In this case, a finer equiaxed microstructure can be obtained.

As described above, each process of the present invention enables titanium and titanium alloy materials having a fine equiaxed microstructure to be stably prepared on a commercial scale, so that the above-described materials having an excellent strength, fatigue properties, and workability, etc. can be stably supplied.

EXAMPLE

EXAMPLE 1

Results of experiment conducted by using a plate (thickness: 4 mm) of a Ti-6Al-4V as a representative ($\alpha+\beta$) alloy without conducting a pretreatment of aging with various changes of the hydrogen content and aging conditions will now be described. All of the materials were annealed in vacuum at 700° C. for 5 hrs for dehydrogenation and recrystallization.

Figure 6:
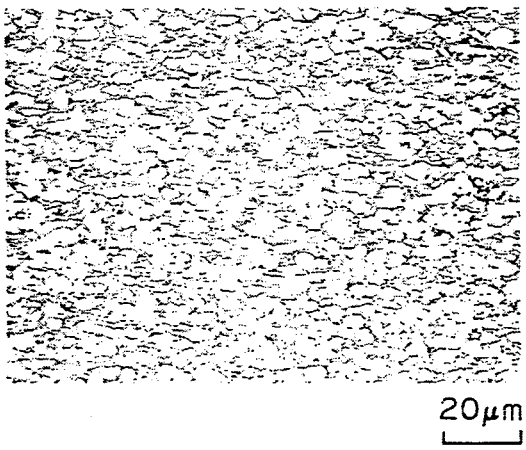

The experimental conditions and evaluation results of microstructure of the finally prepared materials are shown in Table 1. Material No. 25 having a hydrogen content of 2.2% by weight became very brittle and cracked during aging, so that subsequent annealing in vacuum could not be conducted. FIG. 1 is a micrograph of an example of the present invention (No. 14 shown in Table 1) wherein a material having a hydrogen content of 0.9% by weight as a representative example of the microstructure was aged at 500° C. for 8 hrs and then annealed in vacuum at 700° C. for 5 hrs, thereby dehydrogenating the material. FIG. 6 is a micrograph of a comparative material prepared by repeatedly heating and hot rolling without addition of hydrogen and then annealing the treated material for recrystallization. Thus, it is apparent that according to the present invention, a material having a fine equiaxed microstructure can be obtained.

The same experiment as that described above was conducted on titanium (JIS grade 2) and Ti-5Al-2.5Sn alloy, except that with respect to titanium, annealing in vacuum as a final step was conducted by holding the material at 600° C. for 1 hr. The experimental conditions and results are shown in Tables 2 and 3. From the results, it is apparent that the same effect as that of the above described experiment can be attained.

TABLE 1

Experimental results of Ti—6Al—4V alloy

| Classification | Run No. | Experimental conditions: Hydrogen content by weight (%) | Aging temp. (°) | Aging time (hr) | Evaluation results of microstructure: Grain size (μm) | Aspect ratio |
|---|---|---|---|---|---|---|
| Present invention | 1 | 0.02 | 500 | 20 | 6 | 1.1 |
| | 2 | 0.04 | 500 | 10 | 5 | 1.0 |
| | 3 | 0.2 | 300 | 15 | 3 | 1.1 |
| | 4 | 0.2 | 400 | 8 | 3 | 1.1 |
| | 5 | 0.2 | 500 | 3 | 4 | 1.0 |
| | 6 | 0.9 | 20 | 40 | 3 | 1.1 |
| | 7 | 0.9 | 50 | 30 | 3 | 1.1 |
| | 8 | 0.9 | 100 | 20 | 2 | 1.1 |
| | 9 | 0.9 | 300 | 8 | 2 | 1.0 |
| | 10 | 0.9 | 400 | 5 | 2 | 1.0 |
| | 11 | 0.9 | 500 | 0.1 | 5 | 1.1 |
| | 12 | 0.9 | 500 | 0.5 | 4 | 1.1 |
| | 13 | 0.9 | 500 | 2 | 3 | 1.0 |
| | 14 | 0.9 | 500 | 8 | 2 | 1.0 |
| | 15 | 1.0 | 400 | 3 | 2 | 1.0 |
| | 16 | 1.0 | 500 | 0.5 | 3.7 | 1.1 |
| | 17 | 1.0 | 500 | 2 | 2.8 | 1.0 |
| | 18 | 1.0 | 500 | 8 | 1.8 | 1.0 |
| | 19 | 1.5 | 400 | 3 | 2 | 1.0 |
| | 20 | 1.5 | 500 | 1 | 3 | 1.0 |
| | 21 | 2.0 | 100 | 15 | 2 | 1.0 |
| Comparative | 22 | 0.01 | 500 | 20 | 12 | 1.4 |
| | 23 | 0.9 | 0 | 50 | 10 | 1.4 |
| | 24 | 0.9 | 550 | 8 | 13 | 1.2 |
| | 25 | 2.2 | 100 | 15 | — | — |

TABLE 2

Experimental results of titanium (JIS grade 2)

| Classification | Run No. | Experimental conditions: Hydrogen content by weight (%) | Aging temp. (°) | Aging time (hr) | Evaluation results of microstructure: Grain size (μm) | Aspect ratio |
|---|---|---|---|---|---|---|
| Present invention | 1 | 0.02 | 400 | 15 | 8 | 1.1 |
| | 2 | 0.2 | 250 | 8 | 7 | 1.0 |
| | 3 | 0.2 | 400 | 5 | 8 | 1.0 |

TABLE 2-continued

Experimental results of titanium (JIS grade 2)

| Classification | Run No. | Experimental conditions: Hydrogen content by weight (%) | Aging temp. (°) | Aging time (hr) | Evaluation results of microstructure: Grain size (μm) | Aspect ratio |
|---|---|---|---|---|---|---|
| | 4 | 0.5 | 20 | 40 | 9 | 1.1 |
| | 5 | 0.5 | 100 | 10 | 6 | 1.1 |
| | 6 | 0.5 | 200 | 8 | 5 | 1.1 |
| | 7 | 0.5 | 400 | 2 | 6 | 1.0 |
| Comparative | 8 | 0.01 | 400 | 15 | 19 | 1.1 |
| | 9 | 0.5 | 0 | 50 | 15 | 1.1 |
| | 10 | 0.5 | 550 | 2 | 20 | 1.0 |

TABLE 3

Experimental results of Ti—5Al—2.5Sn

| Classification | Run No. | Experimental conditions: Hydrogen content by weight (%) | Aging temp. (°) | Aging time (hr) | Evaluation results of microstructure: Grain size (μm) | Aspect ratio |
|---|---|---|---|---|---|---|
| Present invention | 1 | 0.02 | 500 | 20 | 7 | 1.1 |
| | 2 | 0.2 | 500 | 3 | 5 | 1.0 |
| | 3 | 0.9 | 300 | 8 | 3 | 1.1 |
| | 4 | 0.9 | 500 | 2 | 4 | 1.0 |
| | 5 | 1.0 | 300 | 6 | 3 | 1.0 |
| | 6 | 1.0 | 500 | 1 | 4 | 1.0 |
| Comparative | 7 | 0.01 | 500 | 20 | 14 | 1.3 |
| | 8 | 0.9 | 0 | 50 | 12 | 1.5 |
| | 9 | 0.9 | 550 | 2 | 15 | 1.2 |

EXAMPLE 2

The results of experiments conducted by using a plate (thickness: 4 mm) of a Ti-6Al-4V as a representative $(\alpha+\beta)$ titanium alloy with various changes of pretreatment temperature in addition to the hydrogen content and aging condition will now be described. All of the materials were annealed in vacuum at 700° C. for 5 hrs for dehydrogenation and recrystallization.

Figure 2:
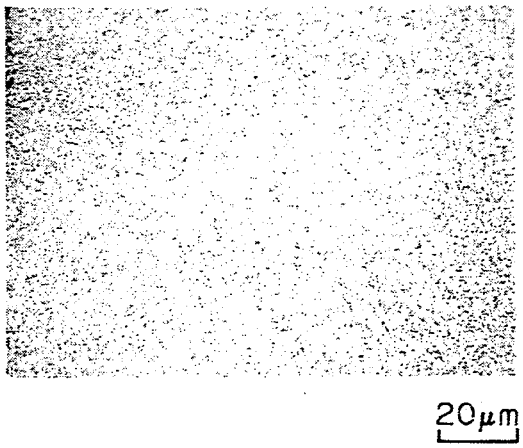

The experimental conditions and evaluation results of microstructure of finally prepared materials are shown in Table 4. A material (No. 24 shown in Table 4) having a hydrogen content of 2.2% by weight became very brittle and cracked during aging, so that subsequent annealing in vacuum could not be conducted. FIG. 2 is a micrograph of an example of the present invention (No. 16 shown in Table 4) wherein a material having a hydrogen content of 1.0% by weight as a representative example of the microstructure was pretreated at 830° C., aged at 500° C. for 8 hrs, and annealed in vacuum at 700° C. for 5 hrs for dehydrogenation and recrystallization. FIG. 6 is a micrograph of a comparative material prepared by repeatedly heating and hot rolling without hydrogenation and then annealing the treated material for recrystallization. Thus, it is apparent that, according to the present invention, it is possible to obtain a material having a fine equiaxed microstructure.

The same experiment as that described above was conducted on titanium (JIS grade 2) and Ti-5Al-2.5Sn alloy as a representative $\alpha$ titanium alloy except that, with respect to titanium, annealing in vacuum as a final step was conducted by holding the material at 600° C. for 1 hr. The experimental conditions and results are shown in Tables 5 and 6. From the results, it is apparent that the same effect as that of the above-described experiments can be attained.

TABLE 4

| Classification | Run No. | Experimental results of Ti—6Al—4V alloy (Pretreatment effected) | | | | | |
|---|---|---|---|---|---|---|---|
| | | Experimental conditions | | | | Evaluation results of microstructure | |
| | | Hydrogen content, by weight (%) | Pretreatment temp. (°C.) | Aging temp. (°C.) | Aging time (hr) | Grain size (μm) | Aspect ratio |
| Present invention | 1 | 0.02 | 1050 | 500 | 10 | 4 | 1.0 |
| | 2 | 0.2 | 900 | 300 | 15 | 2 | 1.1 |
| | 3 | 0.2 | 900 | 400 | 8 | 2 | 1.1 |
| | 4 | 0.2 | 1000 | 500 | 3 | 3 | 1.0 |
| | 5 | 1.0 | 850 | 20 | 40 | 2 | 1.1 |
| | 6 | 1.0 | 850 | 50 | 30 | 2 | 1.0 |
| | 7 | 1.0 | 950 | 100 | 20 | 1.5 | 1.1 |
| | 8 | 1.0 | 700 | 300 | 8 | 1.5 | 1.0 |
| | 9 | 1.0 | 830 | 400 | 3 | 1.5 | 1.0 |
| | 10 | 1.0 | 750 | 500 | 0.1 | 4 | 1.1 |
| | 11 | 1.0 | 800 | 500 | 0.5 | 3 | 1.0 |
| | 12 | 1.0 | 950 | 500 | 0.5 | 2.5 | 1.0 |
| | 13 | 1.0 | 750 | 500 | 2 | 2.5 | 1.0 |
| | 14 | 1.0 | 830 | 500 | 2 | 2 | 1.0 |
| | 15 | 1.0 | 750 | 500 | 8 | 1.5 | 1.0 |
| | 16 | 1.0 | 830 | 500 | 8 | 1 | 1.0 |
| | 17 | 1.5 | 850 | 400 | 3 | 1.5 | 1.0 |
| | 18 | 1.5 | 850 | 500 | 1 | 2 | 1.0 |
| | 19 | 2.0 | 850 | 100 | 15 | 1.5 | 1.0 |
| Comparative | 20 | 0.01 | 750 | 500 | 10 | 12 | 1.3 |
| | 21 | 1.0 | 650 | 550 | 8 | 10 | 1.2 |
| | 22 | 1.0 | 850 | 0 | 50 | 9 | 1.4 |
| | 23 | 1.0 | 750 | 550 | 8 | 12 | 1.2 |
| | 24 | 2.2 | 850 | 100 | 15 | — | — |

TABLE 5

| Classification | Run No. | Experimental results of Titanium JIS grade 2 (Pretreatment effected) | | | | | |
|---|---|---|---|---|---|---|---|
| | | Experimental conditions | | | | Evaluation results of microstructure | |
| | | Hydrogen content, by weight (%) | Pretreatment temp. (°C.) | Aging temp. (°C.) | Aging time (hr) | Grain size (μm) | Aspect ratio |
| Present invention | 1 | 0.02 | 900 | 250 | 10 | 8 | 1.1 |
| | 2 | 0.2 | 800 | 250 | 8 | 6 | 1.0 |
| | 3 | 0.5 | 750 | 20 | 40 | 7 | 1.0 |
| | 4 | 0.5 | 750 | 100 | 10 | 5 | 1.0 |
| | 5 | 0.5 | 750 | 200 | 8 | 4 | 1.0 |
| | 6 | 0.5 | 750 | 400 | 2 | 5 | 1.0 |
| Comparative | 7 | 0.01 | 900 | 250 | 10 | 16 | 1.1 |
| | 8 | 0.5 | 750 | 0 | 50 | 13 | 1.1 |
| | 9 | 0.5 | 750 | 550 | 2 | 18 | 1.0 |

TABLE 6

| Classification | Run No. | Experimental results of Ti—5Al—2.5Sn alloy (Pretreatment effected) | | | | | |
|---|---|---|---|---|---|---|---|
| | | Experimental conditions | | | | Evaluation results of microstructure | |
| | | Hydrogen content, by weight (%) | Pretreatment temp. (°C.) | Aging temp. (°C.) | Aging time (hr) | Grain size (μm) | Aspect ratio |
| Present invention | 1 | 0.02 | 1100 | 500 | 20 | 6 | 1.1 |
| | 2 | 0.2 | 1000 | 500 | 3 | 4 | 1.0 |
| | 3 | 1.0 | 750 | 300 | 6 | 2.5 | 1.0 |
| | 4 | 1.0 | 850 | 500 | 1 | 3 | 1.0 |
| Comparative | 5 | 0.01 | 1100 | 500 | 20 | 12 | 1.4 |
| | 6 | 1.0 | 650 | 500 | 2 | 12 | 1.4 |
| | 7 | 1.0 | 850 | 0 | 50 | 10 | 1.5 |
| | 8 | 1.0 | 850 | 550 | 2 | 13 | 1.2 |

EXAMPLE 3

Slabs of Ti-6Al-4V alloy as a representative ($\alpha+\beta$) titanium alloy subjected to hydrogenation so as to respectively have hydrogen contents of 0.01%, 0.05%, 0.2%, 0.5%, 0.9%, 1.5% and 2.2% by weight were each heated at 500° C., 600° C., 700° C. and 800° C. and then hot rolled with reductions of 30%, 60%, 70% and 80%. After the hot rolling, the materials were cooled to room temperature, heated at 500° C., held for 8 hrs at that temperature for aging, and then heated at 700° C. for 1 hr under a vacuum of $1\times10^{-4}$ Torr for dehydrogenation and recrystallization.

Figure 3:
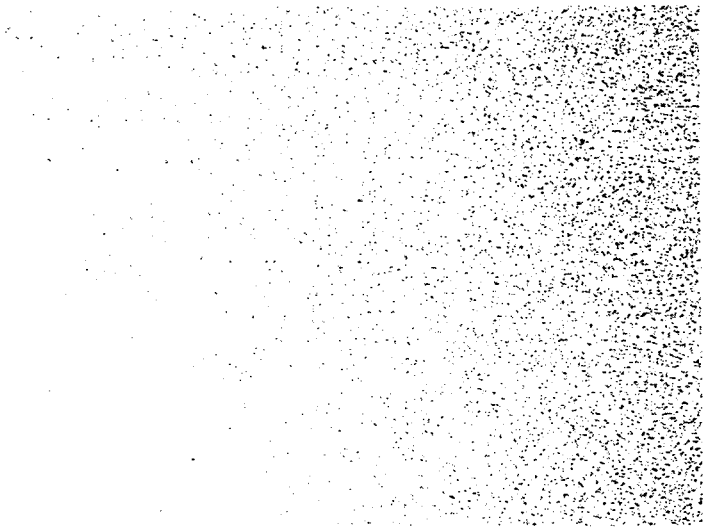

The evaluation results of microstructure of the materials which have been hot rolled, aged and annealed in vacuum are shown in tables 7 to 12. Materials which have been hydrogenated to have hydrogen contents of 0.05%, 0.2%, 0.5%, 0.9% and 1.5% by weight, hot-rolled at 600° C., 700° C. and 800° C. with a reduction of 30% or more had a fine equiaxed microstructure. FIG. 3 is a micrograph of a representative example wherein a material having a hydrogen content of 0.2% by weight was hot-rolled at 750° C. with a reduction of 80%. The material having a hydrogen content of 2.2% by weight became very brittle when hot-rolled and then cooled to room temperature, which made it impossible to conduct subsequent treatments.

Figure 7:
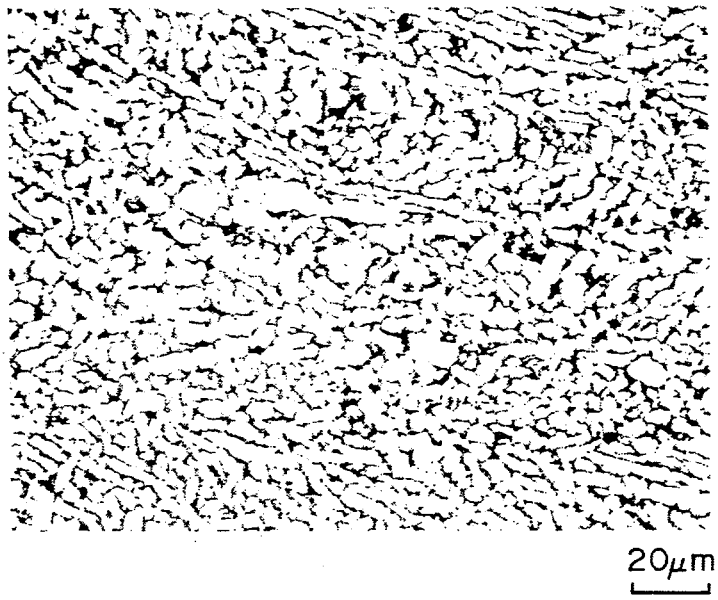

FIG. 7 is a micrograph of a comparative material prepared by the conventional process, i.e., by hot-rolling Ti-6Al-4V alloy free from hydrogen at 950° C. with a reduction of 80% and then recrystallizing the material.

Compared to the materials prepared by the conventional process, the materials prepared according to the present invention had a finer equiaxed microstructure and superior fatigue strength and workability.

TABLE 7

Evaluation results of microstructure of the dehydrogenated materials (Hydrogen content: 0.01% by weight)

| Hot rolling temp. (°C.) | Reduction (%) 30 | 60 | 70 | 80 |
|---|---|---|---|---|
| 500 | Δ | Δ | Δ | Δ |
| 600 | Δ | Δ | Δ | Δ |
| 700 | Δ | Δ | Δ | Δ |
| 800 | Δ | Δ | Δ | Δ |

Note:
Δ: Partially fine equiaxed microstructure.

TABLE 8

Evaluation results of microstructure of the dehydrogenated materials (Hydrogen content: 0.05% by weight)

| Hot rolling temp. (°C.) | Reduction (%) 30 | 60 | 70 | 80 |
|---|---|---|---|---|
| 500 | Δ | Δ | Δ | Δ |
| 600 | ○ | ○ | ○ | ○ |
| 700 | ○ | ○ | ○ | ○ |
| 800 | ○ | ○ | ○ | ○ |

Note:
○: Completely fine equiaxed microstructure.
Δ: Partially fine equiaxed microstructure.

TABLE 9

Evaluation results of microstructure of the dehydrogenated materials (Hydrogen content: 0.2% by weight)

| Hot rolling temp. (°C.) | Reduction (%) 30 | 60 | 70 | 80 |
|---|---|---|---|---|
| 500 | Δ | Δ | Δ | Δ |
| 600 | ○ | ○ | ○ | ○ |
| 700 | ○ | ○ | ○ | ○ |
| 800 | ○ | ○ | ○ | ○ |

Note:
○: Completely fine equiaxed microstructure.
Δ: Partially fine equiaxed microstructure.

TABLE 10

Evaluation results of microstructure of the dehydrogenated materials (Hydrogen content: 0.5% by weight)

| Hot rolling temp. (°C.) | Reduction (%) 30 | 60 | 70 | 80 |
|---|---|---|---|---|
| 500 | Δ | Δ | Δ | Δ |
| 600 | ○ | ○ | ○ | ○ |
| 700 | ○ | ○ | ○ | ○ |

TABLE 10-continued

Evaluation results of microstructure of the dehydrogenated materials (Hydrogen content: 0.5% by weight)

| Hot rolling temp. (°C.) | Reduction (%) 30 | 60 | 70 | 80 |
|---|---|---|---|---|
| 800 | ○ | ○ | ○ | ○ |

Note:
○: Completely fine equiaxed microstructure.
Δ: Partially fine equiaxed microstructure.

TABLE 11

Evaluation results of microstructure of the dehydrogenated materials (Hydrogen content: 0.9% by weight)

| Hot rolling temp. (°C.) | Reduction (%) 30 | 60 | 70 | 80 |
|---|---|---|---|---|
| 500 | Δ | Δ | Δ | Δ |
| 600 | ○ | ○ | ○ | ○ |
| 700 | ○ | ○ | ○ | ○ |
| 800 | ○ | ○ | ○ | ○ |

Note:
○: Completely fine equiaxed microstructure.
Δ: Partially fine equiaxed microstructure.

TABLE 12

Evaluation results of microstructure of the dehydrogenated materials (Hydrogen content: 1.5% by weight)

| Hot rolling temp. (°C.) | Reduction (%) 30 | 60 | 70 | 80 |
|---|---|---|---|---|
| 500 | Δ | Δ | Δ | Δ |
| 600 | ○ | ○ | ○ | ○ |
| 700 | ○ | ○ | ○ | ○ |
| 800 | ○ | ○ | ○ | ○ |

Note:
○: Completely fine equiaxed microstructure.
Δ: Partially fine equiaxed microstructure.

EXAMPLE 4

Hydrogenated Ti-6Al-4V alloy [$(\alpha+\beta)$ type] slabs having a hydrogen content of 0.2% by weight were subjected to $\beta$ heat treatment, i.e., heated at 850° C. and 950° C. being temperatures above the $\beta$ transformation point in the above-described hydrogen content, and air-cooled to room temperature, and then hot-rolled at 500° C., 600° C., 700° C., 750° C. and 800° C. with reductions of 22%, 40%, 60% and 80%. After the hot rolling, the materials were cooled to room temperature, heated at 500° C., held for 8 hrs at that temperature for aging, and heated at 700° C. for 1 hr under a vacuum of $1\times10^{-4}$ Torr for dehydrogenation and recrystallization. The Evaluation results of microstructure of the above-described materials are shown in Table 13 and 14. All of the materials which have been hot-rolled at 600° C., 700° C., 750° C. and 800° C. had a fine equiaxed microstructure in all of the reductions.

TABLE 13

Evaluation results of microstructure of the dehydrogenated materials ($\beta$ heat treatment at 850° C. effected)

| Hot rolling temp. (°C.) | Reduction (%) 22 | 40 | 60 | 80 |
|---|---|---|---|---|
| 500 | Δ | Δ | Δ | Δ |
| 600 | ○ | ○ | ○ | ○ |
| 700 | ○ | ○ | ○ | ○ |
| 750 | ○ | ○ | ○ | ○ |

TABLE 13-continued

| Evaluation results of microstructure of the dehydrogenated materials (β heat treatment at 850° C. effected) | | | | |
|---|---|---|---|---|
| Hot rolling temp. (°C.) | Reduction (%) 22 | 40 | 60 | 80 |
| 800 | ○ | ○ | ○ | ○ |

Note.
○: Completely fine equiaxed microstructure.
Δ: Partially fine equiaxed microstructure.

TABLE 14

| Evaluation results of microstructure of the dehydrogenated materials (β heat treatment at 950° C. effected) | | | | |
|---|---|---|---|---|
| Hot rolling temp. (°C.) | Reduction (%) 22 | 40 | 60 | 80 |
| 500 | Δ | Δ | Δ | Δ |
| 600 | ○ | ○ | ○ | ○ |
| 700 | ○ | ○ | ○ | ○ |
| 750 | ○ | ○ | ○ | ○ |
| 800 | ○ | ○ | ○ | ○ |

Note:
○: Completely fine equiaxed microstructure.
Δ: Partially fine equiaxed microstructure.

EXAMPLE 5

Figure 4:
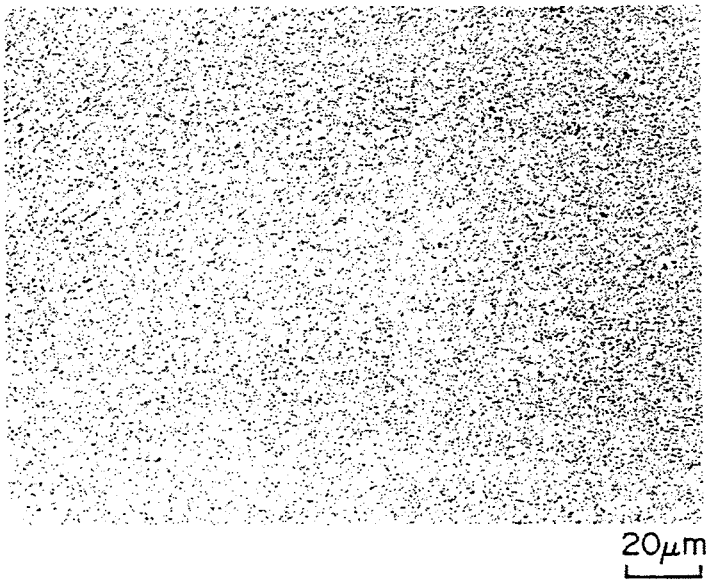

(1) Hydrogenated Ti-6Al-4V alloy [(α+β) type] slabs having varied hydrogen contents were subjected to the β heat treatment, i.e., heated at temperatures above the β transformation point corresponding to the above-described hydrogen content and air-cooled to room temperature. The heat-treated materials and the above-described materials not subjected to the β heat treatment were hot-rolled at 750° C. with a reduction of 60% to prepare 4 mm thick plates. Then, the plates were aged under various conditions and heated at 730° C. for 5 hrs under a vacuum of $1\times10^{-4}$ Torr for dehydrogenation and recrystallization. The grain size and aspect ratio of the final materials are shown in Table 15 together with the β heat treatment temperature and aging conditions. FIG. 4 is a micrograph of the material No. 16 of the present invention shown in Table 15. A material having a hydrogen content of 2.2% by weight as well hot-rolled under the above-described conditions, but this material became very brittle after cooling, which made it impossible to conduct subsequent treatments.

It is apparent that, according to the present invention, an (α+β) titanium alloy having a fine equiaxed microstructure can be obtained.

(2) JIS grade 2 titanium was subjected to treatments for the aging in the same manner as described in the above item (1), and then annealed at 630° C. for 5 hrs under a vacuum of $1\times10^{-4}$ Torr for dehydrogenation and recrystallization. The results are shown in Table 16. As apparent from the results, according to the present invention, titanium having a fine equiaxed microstructure can be obtained.

(3) Ti-5Al-2.5Sn alloy as a representative α titanium alloy was subjected to treatments to the final treatment in the same manner as that described in the above item (1). The results are shown in Table 17. As apparent from the results, according to the present invention, an α titanium alloy having a fine equiaxed microstructure can be obtained.

TABLE 15

| Experimental results of Ti—6Al—4V alloy | | | | | | | |
|---|---|---|---|---|---|---|---|
| | | | | Aging conditions | | | |
| Classification | Run No. | Hydrogen content by weight (%) | β heat treatment temp. (°C.) | Temp. (°C.) | Time (hr) | Grain size (μm) | Aspect ratio |
| Present invention | 1 | 0.03 | — | 500 | 10 | 6 | 1.1 |
| | 2 | 0.03 | 1000 | 500 | 10 | 5 | 1.0 |
| | 3 | 0.15 | 900 | 300 | 15 | 3 | 1.1 |
| | 4 | 0.15 | — | 400 | 8 | 5 | 1.1 |
| | 5 | 0.15 | 900 | 400 | 8 | 4 | 1.0 |
| | 6 | 0.15 | 900 | 500 | 3 | 5 | 1.0 |
| | 7 | 0.4 | 860 | 20 | 40 | <1 | 1.1 |
| | 8 | 0.4 | 860 | 50 | 30 | <1 | 1.0 |
| | 9 | 0.4 | 860 | 100 | 20 | 1 | 1.1 |
| | 10 | 0.4 | 860 | 300 | 8 | 2 | 1.0 |
| | 11 | 0.4 | 860 | 400 | 5 | 3 | 1.0 |
| | 12 | 0.4 | — | 500 | 0.1 | 6 | 1.1 |
| | 13 | 0.4 | 860 | 500 | 0.1 | 5 | 1.1 |
| | 14 | 0.4 | 860 | 500 | 0.5 | 5 | 1.1 |
| | 15 | 0.4 | 860 | 500 | 2 | 4 | 1.0 |
| | 16 | 0.4 | 860 | 500 | 8 | 3 | 1.0 |
| | 17 | 2.0 | 830 | 100 | 15 | <1 | 1.0 |
| Comparative | 18 | 0.01 | 1040 | 500 | 15 | 11 | 1.4 |
| | 19 | 0.4 | — | 600 | 8 | 16 | 1.3 |
| | 20 | 0.4 | 860 | 600 | 8 | 14 | 1.2 |
| | 21 | 2.2 | 830 | 100 | 15 | — | — |

TABLE 16

| Experimental results of Titanium JIS grade 2 | | | | | | | |
|---|---|---|---|---|---|---|---|
| | | | | Aging conditions | | | |
| Classification | Run No. | Hydrogen content by weight (%) | β heat treatment temp. (°C.) | Temp. (°C.) | Time (hr) | Grain size (μm) | Aspect ratio |
| Present invention | 1 | 0.15 | — | 250 | 5 | 6 | 1.1 |
| | 2 | 0.15 | 880 | 250 | 5 | 5 | 1.0 |
| | 3 | 0.2 | — | 100 | 8 | 4 | 1.1 |
| | 4 | 0.2 | 850 | 100 | 8 | 2 | 1.1 |

TABLE 16-continued

| Classification | Run No. | Hydrogen content by weight (%) | β heat treatment temp. (°C.) | Aging conditions Temp. (°C.) | Aging conditions Time (hr) | Grain size (μm) | Aspect ratio |
|---|---|---|---|---|---|---|---|
| | | Experimental results of Titanium JIS grade 2 | | | | | |
| | 5 | 0.2 | 850 | 200 | 2 | 4 | 1.0 |
| Comparative | 6 | 0.01 | 950 | 250 | 10 | 15 | 1.4 |
| | 7 | 0.3 | — | 600 | 2 | 18 | 1.4 |
| | 8 | 0.3 | 820 | 600 | 2 | 17 | 1.3 |

TABLE 17

| Classification | Run No. | Hydrogen content by weight (%) | β heat treatment temp. (°C.) | Aging conditions Temp. (°C.) | Aging conditions Time (hr) | Grain size (μm) | Aspect ratio |
|---|---|---|---|---|---|---|---|
| | | Experimental results of Ti—5Al—2.5Sn alloy | | | | | |
| Present invention | 1 | 0.15 | — | 500 | 3 | 6 | 1.1 |
| | 2 | 0.15 | 950 | 500 | 3 | 5 | 1.0 |
| | 3 | 0.2 | — | 300 | 8 | 3 | 1.1 |
| | 4 | 0.2 | 930 | 300 | 8 | 2 | 1.1 |
| | 5 | 0.2 | 930 | 500 | 2 | 4 | 1.0 |
| Comparative | 6 | 0.01 | 1080 | 500 | 15 | 12 | 1.4 |
| | 7 | 0.5 | — | 600 | 2 | 15 | 1.4 |
| | 8 | 0.5 | 900 | 600 | 2 | 14 | 1.3 |

EXAMPLE 6

(1) A Ti-6Al-4V alloy slab as an (α+β) titanium alloy was heated in a hydrogen atmosphere of 1 atmospheric pressure at 800° C. for 1 to 40 hrs so as to have the hydrogen contents shown in Table 18 and hot-rolled at temperatures shown in Table 18 with a reduction of 60% to prepare 6 mm thick plates. After the hot rolling, the plates were cooled to room temperature, held for 8 hrs at 500° C. for aging, and annealed in vacuum at 700° C. for 10 hrs for dehydrogenation and recrystallization. The microstructure of the central portion of each material was observed, and as a result it was found that, as shown in Table 18, the materials prepared by heating materials having hydrogen contents of 0.25%, 1.6% and 2.1% by weight at 910° C. and 1000° C. in the β region and hot-rolling and aging the materials had an intended fine equiaxed microstructure.

Figure 5:
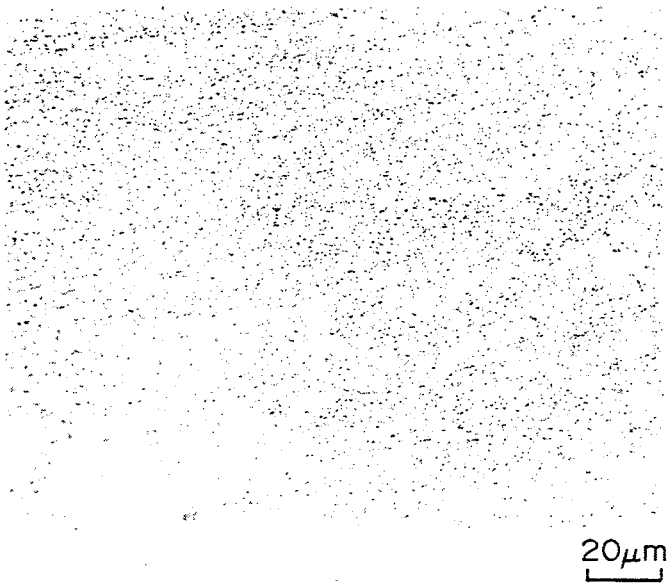

A representative microstructure prepared by hot-rolling a material having a hydrogen content of 0.25% by weight at 910° C., aging the hot-rolled material at 500° C. for 8 hrs and annealing the aged material in vacuum is shown in FIG. 5. The materials having a hydrogen content as low as 0.006% provided no intended microstructure at any temperature. The microstructure of the materials having hydrogen contents of 0.25%, 1.6% and 2.1% by weight was refined to a certain extent by hot-rolling at 1100° C., but an intended microstructure cannot be obtained from these materials because the original β grain is coarse. The material having a hydrogen content of 2.1% by weight cracked during handing after aging.

TABLE 18

| Hydrogen content by weight (%) | Hot rolling temp. (°C.) 910 | 1000 | 1100 |
|---|---|---|---|
| 0.006 | Coarse equiaxed microstructure | Coarse acicular microstructure | Coarse acicular microstructure |
| 0.25 | Fine equiaxed microstructure | Fine equiaxed microstructure | Partially coarse acicular microstructure |
| 1.6 | Fine equiaxed microstructure | Fine equiaxed microstructure | Partially coarse acicular microstructure |
| 2.1 | Fine equiaxed microstructure | Fine equiaxed microstructure | Partially coarse acicular microstructure |

(2) An ingot of Ti-6Al-4V alloy as an (α+β) titanium alloy was heated in a hydrogen atmosphere of 1 atmospheric pressure at 850° C. for 2 to 30s hr to prepare hydrogenated materials having hydrogen contents shown in Table 19 and hot-extruded at 950° C. with a reduction of 80% to prepare round bars having a diameter of 40 mm. After the hot-extrusion, the round bars were cooled to room temperature and then held for 8 hrs at temperatures shown in Table 19 for aging. Thereafter, the round bars were annealed in vacuum at 750° C. for 15 hrs for dehydrogenation and recrystallization. The microstructure of the central portion of each material was observed. As shown in Table 19, the materials having hydrogen contents of 0.21%, 1.3% and 2.2% by weight provided an intended fine equiaxed microstructure when the aging temperature was 50° C., 300° C. and 500° C. The material having a hydrogen content as low as 0.007% by weight provided no intended microstructure at any aging temperatures. The materials subjected to aging at 0° C. had an ununiform microstructure in any hydrogen content. The materials subjected to aging at 800° C. had a coarse equiaxed microstructure in any hydrogen content. The material having a hydrogen content of 2.2% by weight cracked during handling after aging.

TABLE 19

| Hydrogen content by weight (%) | Aging temperature (°C.) 0 | 50 | 300 | 500 | 800 |
|---|---|---|---|---|---|
| 0.007 | Not uniform equiaxed microstructure | Not uniform equiaxed microstructure | Not uniform equiaxed microstructure | Not uniform equiaxed microstructure | Coarse equiaxed microstructure |
| 0.21 | Not uniform equiaxed microstructure | Fine equiaxed microstructure | Fine equiaxed microstructure | Fine equiaxed microstructure | Coarse equiaxed microstructure |
| 1.3 | Not uniform equiaxed microstructure | Fine equiaxed microstructure | Fine equiaxed microstructure | Fine equiaxed microstructure | Coarse equiaxed microstructure |
| 2.2 | Not uniform equiaxed microstructure | Fine equiaxed microstructure | Fine equiaxed microstructure | Fine equiaxed microstructure | Coarse equiaxed microstructure |

The JIS grade 2 commercially pure titanium was also subjected to treatments, to the aging, in the same manner as described in the above item (2) and then annealed at 650° C. for 3 hrs under a vacuum of $1\times10^{-4}$ Torr for dehydrogenation and recrystallization, and as a result, it was found that, according to the present invention, JIS grade 2 pure titanium having a fine equiaxed microstructure can be obtained.

EXAMPLE 7

An ingot of Ti-5Al-2.5Sn alloy as an $\alpha$ titanium alloy was heated in a hydrogen atmosphere of 1 atmospheric pressure at 850° C. for 1 to 24 hrs to prepare hydrogenated materials having hydrogen contents shown in Table 20 and subjected to the $\beta$ heat treatment, i.e., heated at 1000° C. for 2 hrs and then air-cooled to room temperature. Thereafter, the materials were hot-rolled at each temperature shown in Table 20 with a reduction of 40% to prepare 8 mm thick plates. After the hot rolling, the plates were cooled to 500° C., held for 8 hrs at that temperature for aging. The aged plates were then annealed in vacuum at 700° C. for 10 hrs for dehydrogenation and recrystallization.

The microstructure of the central portion of each material was observed, and as a result it was found that, as shown in Table 20, the plates prepared by heating and hot-rolling materials having hydrogen contents of 0.20%, 1.4% and 2.2% by weight at 940° C. and 1020° C. in the $\beta$ region, and then aging, had an intended fine equiaxed microstructure. The materials having a hydrogen content as low as 0.007% by weight did not provide an intended microstructure at any temperatures. The microstructure of the materials having hydrogen contents of 0.20%, 1.4% and 2.2% by weight was refined to a certain extent by hot-rolling at 1120° C., but an intended microstructure cannot be obtained from these materials because the original $\beta$ grain in coarse. The material having a hydrogen content of 2.2% by weight cracked during handling after aging.

TABLE 20

| Hydrogen content by weight (%) | Hot rolling temp. (°C.) 940 | 1020 | 1120 |
|---|---|---|---|
| 0.007 | Coarse equiaxed microstructure | Coarse acicular microstructure | Coarse acicular microstructure |
| 0.20 | Fine equiaxed microstructure | Fine equiaxed microstructure | Partially coarse acicular microstructure |
| 1.4 | Fine equiaxed microstructure | Fine equiaxed microstructure | Partially coarse acicular microstructure |
| 2.2 | Fine equiaxed microstructure | Fine equiaxed microstructure | Partially coarse acicular microstructure |

EXAMPLE 8

Welded construction materials prepared by allowing plates (thickness: 4 mm) of Ti-6Al-4V alloy as an $(\alpha+\beta)$ titanium alloy to be butt welded were subjected to experiments with varied hydrogen contents and aging temperatures (aging time: 8 hrs). All of the materials were annealed in vacuum at 700° C. for 5 hrs for dehydrogenation and recrystallization.

The experimental conditions and evaluation results of microstructure of the weld metal zone and heat affected zone of the finally obtained weld are shown in Table 21. The material having a hydrogen content of 2.1% by weight was very brittle after aging, and therefore, difficult to handle, which made it impossible to conduct subsequent annealing. Thus, it is apparent that, according to the present invention, materials having a fine equiaxed microstructure can be obtained.

TABLE 21

| Experimental conditions: Hydrogen content by weight (%) | Aging temp. (°C.) | Evaluation results of microstructure: Metal weld zone | Heat affected zone |
|---|---|---|---|
| 0.01 | 500 | Acicular microstructure | Acicular microstructure |
| 0.03 | 20 | Fine equiaxed microstructure | Fine equiaxed microstructure |
| 0.03 | 400 | Fine equiaxed microstructure | Fine equiaxed microstructure |
| 0.8 | 20 | Fine equiaxed microstructure | Fine equiaxed microstructure |
| 0.8 | 400 | Fine equiaxed microstructure | Fine equiaxed microstructure |
| 1.0 | 500 | Fine equiaxed microstructure | Fine equiaxed microstructure |
| 1.5 | 500 | Fine equiaxed microstructure | Fine equiaxed microstructure |
| 2.1 | 400 | — | — |

In the above-described Examples 1 and 2, experiments were conducted on sheet materials, but the same effect was observed on materials having various shapes, such as plate, bar and wire, cast materials and powder compacts In the above-described Examples 3 to 7, experiments were conducted on hot rolling of slabs and hot extrusion of ingots, but the same effect was observed when billets and powder compacts were used as the object material and when forging was used instead of the hot extrusion.

The present invention is not limited to the above-described Examples only.

We claim:

1. A process for preparing titanium and titanium alloy materials having a fine equiaxed microstructure which comprises hydrogenating a titanium, a $\beta$ titanium alloy or $(\alpha+\beta)$ titanium alloy in an amount of 0.02 to 2.0% by weight of hydrogen, aging the hydrogenated material at temperatures of 10° to 530° C. and dehydrogenating the material in vacuum, and simultaneously, recrystallizing the material.

2. A process according to claim 1, wherein the hydrogenated titanium, $\alpha$ titanium alloy or $(\alpha+\beta)$ titanium alloy is pretreated in such a manner that the material is heated at temperatures of 700° to 1100° C. and cooled, and then subjected to said aging.

3. A process according to claim 1, wherein the hydrogenated titanium, $\alpha$ titanium alloy or $(\alpha+\beta)$ titanium alloy is worked at temperatures of 450° to 950° C. in $(\alpha+\beta)$ region with a reduction of at least 30% and then subjected to said aging.

4. A process according to claim 1, wherein the hydrogenated titanium, $\alpha$ titanium alloy or $(\alpha+\beta)$ titanium alloy is heat-treated in such a manner that the material is heated at temperatures above the $\beta$ transformation point and cooled, worked at temperatures of 450° to 950° C. in $(\alpha+\beta)$ region, and then subjected to said aging.

5. A process according to claim 1, wherein the hydrogenated titanium, $\alpha$ alloy or $(\alpha+\beta)$ titanium alloy is worked in such a manner that the material is worked at temperatures above the $\beta$ transformation point and below 1100° C. with a reduction of 30% of more, which is finished in $\beta$ single phase region, and the aging is then conducted at temperatures of 10° to 530° C.

6. A process according to claim 1, wherein the hydrogenated titanium, $\alpha$ titanium alloy or $(\alpha+\beta)$ titanium alloy is heat-treated in such a manner that the material is heated above the $\beta$ transformation point and below 1100° C. and then cooled to 400° C. or lower, worked in such a manner that the heat-treated material is worked at temperatures above the $\beta$ transformation point and below 1100° C., which is finished in the $\beta$ single phase region, and the aging is then conducted at temperatures of 10° to 530° C.

7. A process according to claim 1, wherein the material having an acicular microstructure is hydrogenated in an amount of 0.02 to 2% by weight, aged at temperatures of 10° to 530° C. and then annealed in vacuum.

8. A process according to claim 2, wherein the material having an acicular microstructure is hydrogenated in an amount of 0.02 to 2% by weight, aged at temperatures of 10° to 530° C. and then annealed in vacuum.

9. A process according to claim 3, wherein the working temperature of the titanium is 450° to 800° C. in the $(\alpha+\beta)$ region.

10. A process according to claim 3, wherein the working temperature of the $\alpha$ titanium alloy is 600° to 950° C. in the $(\alpha+\beta)$ region.

11. A process according to claim 3, wherein the working temperature of the $(\alpha+\beta)$ titanium alloy is 550° to 900° C. in the $(\alpha+\beta)$ region.

12. A process according to claim 4, wherein the working temperature of the titanium is 450° to 800° C. in the $(\alpha+\beta)$ region.

13. A process according to claim 4, wherein the working temperature of the $\alpha$ titanium alloy is 600° to 950° C. in the $(\alpha+\beta)$ region.

14. A process according to claim 4, wherein the working temperature of the $(\alpha+\beta)$ titanium alloy is 550° to 900° C. in the $(\alpha+\beta)$ region.

15. A process according to claim 7, wherein said acicular microstructure is an acicular microstructure of a welded construction material comprising said material.

16. A process according to claim 15, wherein said acicular microstructure is an acicular microstructure of a welded construction material comprising said material.

* * * * *

UNITED STATES PATENT AND TRADEMARK OFFICE

CERTIFICATE OF CORRECTION

PATENT NO. : 5,108,517

DATED : April 28, 1992

INVENTOR(S) : Kinichi KIMURA, et al.

It is certified that error appears in the above-identified patent and that said Letters Patent is hereby corrected as shown below:

Column 20, line 64, between "microstructure" and "which" insert --having a grain size between submicron to less than 9 microns--.

Column 20, line 65, change "a β" should read --α--.

Column 22, line 33, change "15," to --8,--.

Signed and Sealed this

Twenty-ninth Day of March, 1994

*Attest:*

Bruce Lehman

BRUCE LEHMAN

*Attesting Officer*

*Commissioner of Patents and Trademarks*